US007819194B2

(12) United States Patent
Tips

(10) Patent No.: US 7,819,194 B2
(45) Date of Patent: Oct. 26, 2010

(54) FLOW REGULATOR FOR USE IN A SUBTERRANEAN WELL

(75) Inventor: Timothy R. Tips, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 402 days.

(21) Appl. No.: 11/346,738

(22) Filed: Feb. 3, 2006

(65) Prior Publication Data

US 2006/0175052 A1 Aug. 10, 2006

(30) Foreign Application Priority Data

Feb. 8, 2005 (WO) ..... PCT/US2005/003928

(51) Int. Cl.
*E21B 34/08* (2006.01)
*E21B 34/10* (2006.01)

(52) U.S. Cl. ..... 166/316; 166/373

(58) Field of Classification Search ..... 166/316, 166/373

See application file for complete search history.

(56) References Cited

U.S. PATENT DOCUMENTS 1,885,820 A 11/1932 Gothard et al.
2,895,063 A 7/1959 Morris
2,960,109 A 11/1960 Wilson
3,342,267 A 9/1967 Cotter et al.
3,398,302 A 8/1968 Harnau et al.
3,663,845 A 5/1972 Apstein
3,766,399 A 10/1973 Demetrescu
3,772,541 A 11/1973 Campagnuolo et al.
3,968,387 A 7/1976 Scarff
3,970,877 A 7/1976 Russell et al.
4,009,756 A 3/1977 Zehren
4,015,234 A 3/1977 Krebs (Continued)

FOREIGN PATENT DOCUMENTS

GB 20044822 10/1980

(Continued)

OTHER PUBLICATIONS

International Preliminary Report on Patentability and Written Opinion issued for PCT/US2005/019087 dated Dec. 21, 2007 (5 pages).

(Continued)

*Primary Examiner*—Shane Bomar
*Assistant Examiner*—Robert E Fuller
(74) *Attorney, Agent, or Firm*—Marlin R. Smith

(57) ABSTRACT

A flow regulator for use in a subterranean well. A well flow regulating system includes a flow regulator for regulating a flow rate of a fluid in a wellbore, the flow rate remaining substantially constant while a differential pressure across the flow regulator varies. The flow regulator is adjustable while positioned within the wellbore to change the flow rate. Another well flow regulating system includes a flow regulator for maintaining a desired fluid flow rate between an annulus and an interior passage of a tubular string. The flow regulator includes a closure device, a biasing device which applies a biasing force to the closure device, and a flow restriction which operates to apply a restriction force to the closure device. The biasing force and/or the restriction force is adjustable downhole to change the flow rate.

37 Claims, 6 Drawing Sheets

U.S. PATENT DOCUMENTS

| | | | | |
|---|---|---|---|---|
| 4,047,832 | A | 9/1977 | Sforza | |
| 4,215,426 | A | 7/1980 | Klatt | |
| 4,362,106 | A | 12/1982 | Campagnuolo et al. | |
| 4,387,318 | A | 6/1983 | Kolm et al. | |
| 4,415,823 | A | 11/1983 | Jurgens | |
| 4,416,000 | A | 11/1983 | Scherbatskoy | |
| 4,464,939 | A | 8/1984 | Corpron | |
| 4,467,236 | A | 8/1984 | Kolm et al. | |
| 4,491,738 | A | 1/1985 | Kamp | |
| 4,536,674 | A | 8/1985 | Schmidt | |
| 4,540,348 | A | 9/1985 | Soderberg | |
| 4,627,294 | A | 12/1986 | Lew | |
| 4,674,397 | A | 6/1987 | Wilcox | |
| 4,769,569 | A | 9/1988 | Stahlhuth | |
| 4,808,874 | A | 2/1989 | Stahlhuth | |
| 4,825,421 | A | 4/1989 | Jeter | |
| 4,858,644 | A * | 8/1989 | Decker | 137/504 |
| 5,101,907 | A | 4/1992 | Schultz et al. | |
| 5,202,194 | A | 4/1993 | VanBerg, Jr. | |
| 5,295,397 | A | 3/1994 | Hall et al. | |
| 5,547,029 | A | 8/1996 | Rubbo et al. | |
| 5,554,922 | A | 9/1996 | Kunkel | |
| 5,626,200 | A | 5/1997 | Gilbert et al. | |
| 5,703,474 | A | 12/1997 | Smalser | |
| 5,801,475 | A | 9/1998 | Kimura | |
| 5,839,508 | A | 11/1998 | Tubel et al. | |
| 5,899,664 | A | 5/1999 | Lawrence | |
| 5,907,211 | A | 5/1999 | Hall et al. | |
| 5,957,208 | A * | 9/1999 | Schnatzmeyer | 166/373 |
| 5,965,964 | A | 10/1999 | Skinner et al. | |
| 5,979,558 | A | 11/1999 | Bouldin et al. | |
| 5,995,020 | A | 11/1999 | Owens et al. | |
| 6,011,346 | A | 1/2000 | Buchanan et al. | |
| 6,020,653 | A | 2/2000 | Woodbridge et al. | |
| 6,112,817 | A | 9/2000 | Voll et al. | |
| 6,179,052 | B1 | 1/2001 | Purkis et al. | |
| 6,217,284 | B1 | 4/2001 | Lawrence | |
| 6,325,150 | B1 * | 12/2001 | Rayssiguier | 166/334.4 |
| 6,351,999 | B1 | 3/2002 | Maul et al. | |
| 6,371,210 | B1 | 4/2002 | Bode et al. | |
| 6,424,079 | B1 | 7/2002 | Carroll | |
| 6,470,970 | B1 | 10/2002 | Purkis et al. | |
| 6,478,091 | B1 | 11/2002 | Gano | |
| 6,504,258 | B2 | 1/2003 | Schultz et al. | |
| 6,554,074 | B2 | 4/2003 | Longbottom | |
| 6,567,013 | B1 | 5/2003 | Purkis et al. | |
| 6,567,895 | B2 | 5/2003 | Scales | |
| 6,575,237 | B2 | 6/2003 | Purkis et al. | |
| 6,585,051 | B2 | 7/2003 | Purkis et al. | |
| 6,607,030 | B2 | 8/2003 | Bauer et al. | |
| 6,644,412 | B2 * | 11/2003 | Bode et al. | 166/373 |
| 6,659,184 | B1 | 12/2003 | Tips et al. | |
| 6,672,382 | B2 | 1/2004 | Schultz | |
| 6,672,409 | B1 | 1/2004 | Dock et al. | |
| 6,717,283 | B2 | 4/2004 | Skinner et al. | |
| 6,768,214 | B2 | 7/2004 | Schultz et al. | |
| 6,786,285 | B2 | 9/2004 | Johnson et al. | |
| 6,874,361 | B1 | 4/2005 | Meltz et al. | |
| 6,914,345 | B2 | 7/2005 | Webster | |
| 6,920,085 | B2 | 7/2005 | Finke et al. | |
| 7,086,471 | B2 * | 8/2006 | Cantin et al. | 166/313 |
| 2002/0096887 | A1 | 7/2002 | Schultz et al. | |
| 2005/0051323 | A1 | 3/2005 | Fripp et al. | |
| 2005/0230973 | A1 | 10/2005 | Fripp et al. | |
| 2005/0230974 | A1 | 10/2005 | Masters et al. | |
| 2006/0064972 | A1 | 3/2006 | Allen | |

FOREIGN PATENT DOCUMENTS

| | | |
|---|---|---|
| WO | WO 01/39284 | 5/2001 |
| WO | WO 02/10553 | 2/2002 |
| WO | WO 02/057589 | 7/2002 |

OTHER PUBLICATIONS

Jaffe, B., Cook, W. R., Jaffe, H., "Piezoelectric Ceramics", Marietta: R.A.N. Publishers, 1971; Chapters 1, 2 and 12.
Journal of Hydraulic Engineering, "Sediment Management with Submerged Vanes. 1: Theory", vol. 117, dated Mar. 1991.
McGraw-Hill, Inc., "Fluid Mechanics", dated 1979, 1986.
Office Action dated Aug. 28, 2006 for U.S. Appl. No. 10/826,952.
Examination Report for UK application serial No. GB0419933.7.
U.K. Search Report for application No. GB 0419933.7.
International Search Report for PCT/US2005/019087.
Written Opinion for PCT/US2005/019087.
International Search Report for PCT/US2005/029007.
Written Opinion for PCT/US2005/029007.
International Search Report for PCT/US2005/003928.
Written Opinion for PCT/US2005/003928.
International Search Report for PCT/US2005/003911.
Written Opinion for PCT/US2005/003911.
Baker Oil Tools, "Flow Control Systems", undated.
"Extracting Energy From Natural Flow", NASA Tech Briefs, Spring 1980, vol. 5, No. 1, MFS-23989.
Blevins, Robert, "Flow induced vibration", Van Nostrand Reinhold Co., N.Y., 1977; Chapters 3 and 4.
Official Action issued Mar. 5, 2009, by the Canadian Intellectual Property Office for Canadian Patent Application Serial No. 2,596,408, 2 pages.
Office Action issued Apr. 6, 2009, with English translation for Russian Patent Application Serial No. 2008110087, 3 pages.
Office Action issued Sep. 24, 2009, for U.S. Appl. No. 11/442,888, 42 pages.
European Search Report issued for European Patent Application No. 05713094.0 dated May 10, 2010, 3 pages.
Official Action issued Mar. 11, 2010, by the Canadian Intellectual Property Office for Canadian Patent Application Serial No. 2,596,408, 2 pages.
International Preliminary Report on Patentability and Written Opinion issued for International Patent Application No. PCT/US2005/029007 dated Feb. 28, 2008 (5 pages).

* cited by examiner

FLOW REGULATOR FOR USE IN A SUBTERRANEAN WELL

TECHNICAL FIELD

The present invention relates generally to equipment utilized and services performed in conjunction with a subterranean well and, in an embodiment described herein, more particularly provides a flow regulator for use in a well.

BACKGROUND

It is beneficial to be able to regulate a rate of fluid flow out of, or into, a formation or zone intersected by a wellbore. Downhole chokes have been developed in the past to enable regulation of production and/or injection flow rates. However, improvements are needed to address certain situations encountered in the downhole environment.

For example, a typical downhole choke is configured at the surface to permit a certain flow rate when a certain pressure differential of a certain density fluid is applied across the choke. Then, the choke is installed in the wellbore. If conditions change (such as increased water production, decreased reservoir pressure, etc.) and it is desired to change the choke settings, the choke must be retrieved from the wellbore, reconfigured and then installed in the wellbore in an expensive and time-consuming process.

If conditions change again, the process must be repeated again. In particular, if the pressure differential across the choke changes, the flow rate through the choke also changes.

Another type of downhole choke can be adjusted from the surface using hydraulic control lines. Unfortunately, the choke still cannot respond to varying downhole conditions (such as changing pressure differentials) to maintain a substantially constant flow rate.

Therefore, it may be seen that improvements are needed in downhole flow regulating systems. It is an object of the present invention to provide such improvements.

SUMMARY

In carrying out the principles of the present invention, a flow regulating system is provided which solves one or more problems in the art. One example is described below in which a flow regulator permits a desired flow rate over a wide range of pressure differentials, and the flow rate is adjustable downhole. Another example is described below in which a flow regulator automatically responds to changing downhole conditions by changing a flow rate through the flow regulator.

In one aspect of the invention, a well flow regulating system is provided which includes a flow regulator for regulating a flow rate of a fluid in a wellbore. The flow rate remains substantially constant while a differential pressure across the flow regulator varies. The flow regulator is adjustable while positioned within the wellbore to change the flow rate.

In another aspect of the invention, a well flow regulating system is provided which includes a tubular string positioned in a wellbore. An annulus is formed between the tubular string and the wellbore. A flow regulator maintains a desired fluid flow rate between the annulus and an interior passage of the tubular string, or compensates for fluid density changes while maintaining a constant flow rate.

The flow regulator includes a closure device, a biasing device and a flow restriction. The biasing device applies a biasing force to the closure device in one direction, and the flow restriction operates to apply a restriction force to the closure device in an opposite direction. At least one of the biasing force and the restriction force is adjustable downhole to change the flow rate.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
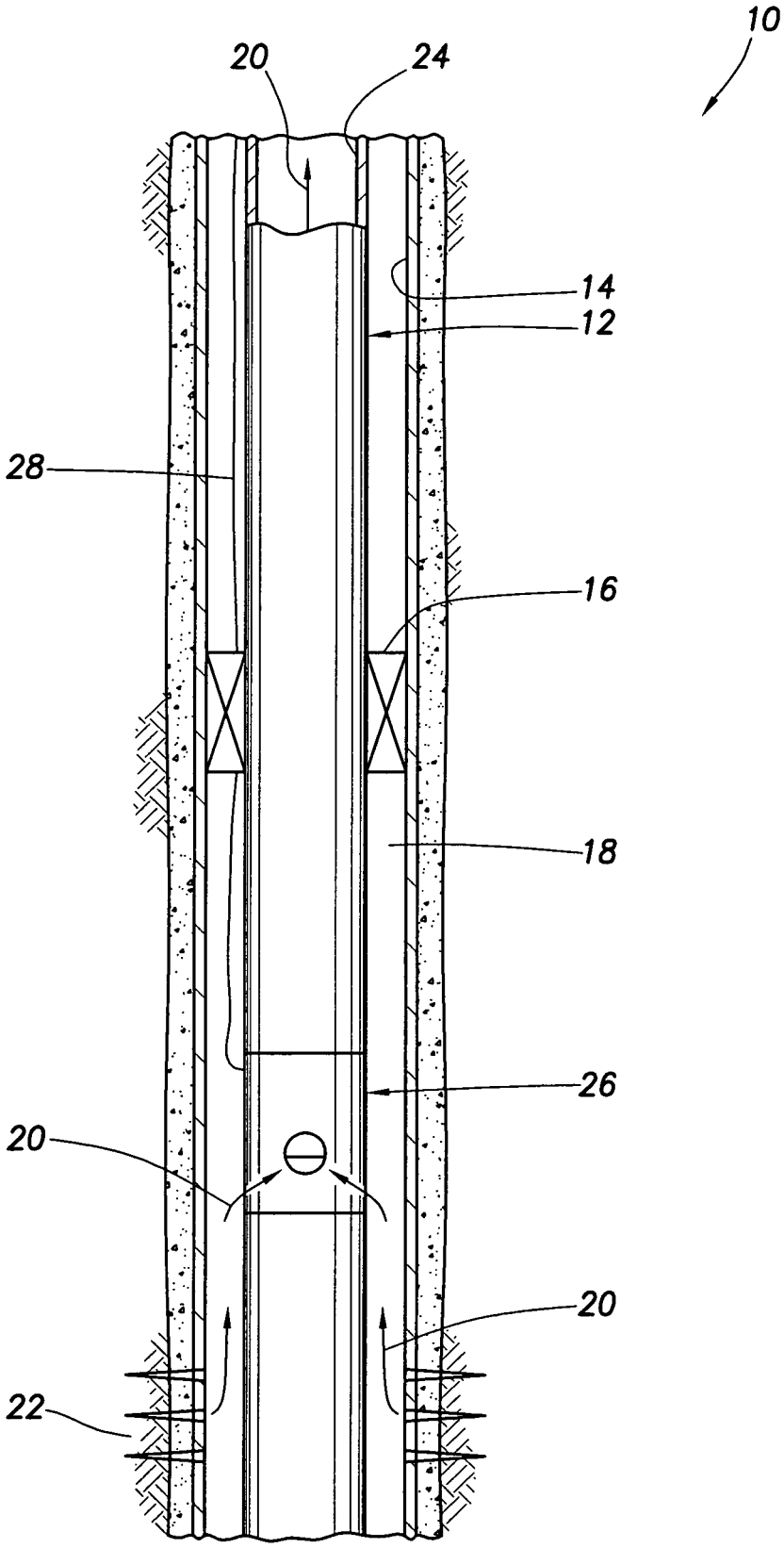
FIG. 1 is a schematic partially cross-sectional view of a well flow regulating system embodying principles of the present invention.

Representatively illustrated in FIG. 1 is a well flow regulating system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 has been installed in a wellbore 14. A packer 16 seals off an annulus 18 formed radially between the tubular string 12 and the wellbore 14. Fluid (represented by arrows 20) is thus constrained to flow from a formation or zone 22 intersected by the wellbore 14 into an interior passage 24 of the tubular string 12 via a flow regulator 26 interconnected in the tubular string.

Although the system 10 is described as being used to produce the fluid 20 from the zone 22, it should be clearly understood that it is not necessary for the fluid to be produced in keeping with the principles of the invention. The fluid 20 could instead be injected or the fluid 20 could be transferred from one zone to another via the wellbore 14, etc. Thus, the particular direction of flow or destination of the fluid 20 can be changed without departing from the principles of the invention.

In one important feature of the system 10, the flow regulator 26 maintains a certain flow rate of the fluid 20 from the annulus 18 into the passage 24 over a wide range of pressure differentials. In another important feature of the system 10, the flow regulator 26 can be adjusted downhole to change the flow rate of the fluid 20, for example, using pressure applied via one or more lines 28 extending to a remote location (such as the earth's surface or another location in the well). In yet another important feature of the system 10, the flow regulator 26 in certain configurations can be adjusted automatically and intelligently in response to changing downhole conditions.

Figure 2:
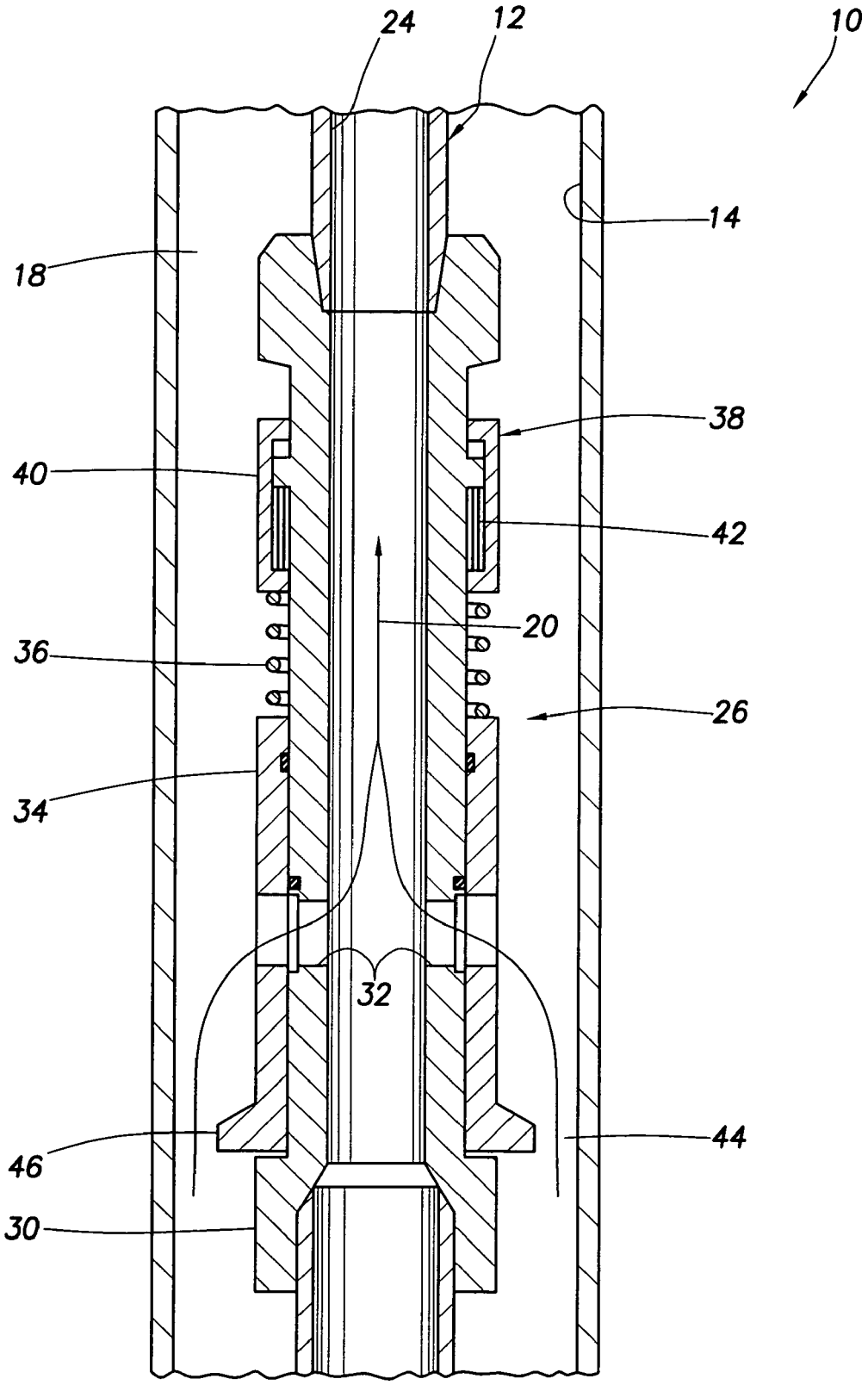
FIG. 2 is an enlarged scale schematic cross-sectional view of the system of FIG. 1 depicting further details of a flow regulator of the system.

Referring additionally now to FIG. 2, an enlarged cross-sectional view of the system 10 is representatively illustrated. Depicted in FIG. 2 is one possible configuration of the flow regulator 26. Note that the flow regulator 26 includes a generally tubular housing 30 having openings 32 formed through its sidewall to permit the fluid 20 to flow between the annulus 18 and the passage 24.

A closure device 34 is used to selectively close off or open up the openings 32 to thereby regulate the flow rate of the fluid 20 through the openings. As shown in FIG. 2, the openings 32 are fully open, but upward displacement of the closure device 34 will operate to progressively close off the openings, thereby reducing the flow rate of the fluid 20 through the openings. Although the closure device 34 is depicted in FIG. 2 as being positioned external to the housing 30, it could be otherwise positioned (such as internal to the housing, within the housing sidewall, etc.) in keeping with the principles of the invention.

A biasing device 36 (such as a spring, gas charge, or other type of biasing device) is used to resiliently apply a downwardly directed biasing force to the closure device 34. Thus, the biasing device 36 biases the closure device 34 toward its position in which the openings 32 are fully open.

An actuator 38 is used to vary the biasing force applied to the closure device 34 by the biasing device 36. The actuator 38 includes a sleeve 40 reciprocably mounted on the housing 30, and a temperature responsive shape memory material 42. The material 42 is positioned between shoulders formed on the sleeve 40 and the housing 30, so that the sleeve is displaced downward when the material is in its elongated condition (as depicted in FIG. 2), and the sleeve may be displaced upward when the material is in its contracted condition.

When the sleeve 40 is in its downwardly displaced position (as shown in FIG. 2), an increased biasing force is applied to the closure device 34 by the biasing device 36 due to the biasing device being further compressed between the sleeve and the closure device. When the sleeve 40 is in its upwardly displaced position, a reduced biasing force is applied to the closure device 34 by the biasing device 36 due to the biasing device being less compressed between the sleeve and the closure device.

The shape memory material 42 alternates between its elongated and contracted conditions in response to temperature changes in the wellbore 14. For example, the material 42 may change shape in response to a change in temperature of the fluid 20 flowing through the passage 24 (e.g., due to increased water or gas production). This change in shape of the material 42 may be used to change the flow rate of the fluid 20 flowing into the openings 32 by changing the biasing force applied to the closure device 34 by the biasing device 36, as described in further detail below.

A flow restriction 44 is formed in the annulus 18 due to an outwardly extending annular shaped projection 46 on a lower end of the closure device 34. Flow of the fluid 20 through this restriction 44 creates a pressure differential across the projection 46 (e.g., due to the Bernoulli principle or venturi effect), thereby applying an upwardly directed force to the closure device 34.

If the upwardly directed force applied to the closure device 34 due to the flow restriction 44 exceeds the downwardly directed biasing force applied to the closure device by the biasing device 36, the closure device will displace upward, thereby decreasing the flow rate of the fluid 20 through the openings 32. This decreased flow rate will decrease the pressure differential across the projection 46, thereby reducing the upwardly directed force applied to the closure device 34 due to the flow restriction 44.

If the downwardly directed force applied to the closure device 34 by the biasing device 36 exceeds the upwardly directed biasing force applied to the closure device due to the flow restriction 44, the closure device 34 will displace downward, thereby increasing the flow rate of the fluid 20 through the openings 32. This increased flow rate will increase the pressure differential across the projection 46, thereby increasing the upwardly directed force applied to the closure device 34 due to the flow restriction 44.

For a given set of conditions, a state of equilibrium preferably exists in which the biasing force applied to the closure device 34 by the biasing device 36 equals the force applied to the closure device due to the flow restriction 44. At this state of equilibrium, the closure device 34 is preferably in a position in which the openings 32 are partially open (i.e., the closure device is between its fully open and fully closed positions), thereby permitting a certain flow rate of the fluid 20 through the openings.

If a pressure differential between the annulus 18 and the passage 24 should change (e.g., due to reduced reservoir pressure over time, etc.), the flow regulator 26 compensates by maintaining substantially the same flow rate of the fluid 20. For example, if the pressure differential from the annulus 18 to the passage 24 decreases, the force applied to the closure device 34 due to the flow restriction 44 will also decrease and the biasing force applied by the biasing device 36 will displace the closure device downward to a position in which the-openings 32 are further opened, thereby maintaining the desired flow rate of the fluid 20 through the openings.

If the pressure differential from the annulus 18 to the passage 24 increases, the force applied to the closure device 34 due to the flow restriction 44 will also increase and displace the closure device upward to a position in which the openings 32 are further closed, thereby maintaining the desired flow rate of the fluid 20 through the openings. Thus, the flow rate of the fluid 20 through the openings 32 is maintained whether the pressure differential increases or decreases.

As described above, the biasing force applied by the biasing device 36 to the closure device 34 can be changed by the actuator 38. It will be readily appreciated by those skilled in the art that an increase in the biasing force will result in the closure device 34 being further downwardly positioned at the state of equilibrium, thereby permitting an increased flow rate of the fluid 20 through the openings 32, and a decrease in the biasing force will result in the closure device 34 being further upwardly positioned at the state of equilibrium, thereby permitting a decreased flow rate of the fluid 20 through the openings.

Therefore, the flow rate of the fluid 20 through the openings 32 can be automatically adjusted downhole by the actuator 38 in response to changing downhole conditions, such as a change in temperature of the fluid. This may be useful in many situations, such as when an increased production of water occurs and it is desired to reduce the flow rate of the fluid 20. A decrease in temperature of the fluid 20 may cause the material 42 to contract, thereby reducing the downward biasing force applied to the closure device 34, resulting in the closure device being positioned further upward and reducing the flow rate through the openings 32.

Figure 3:
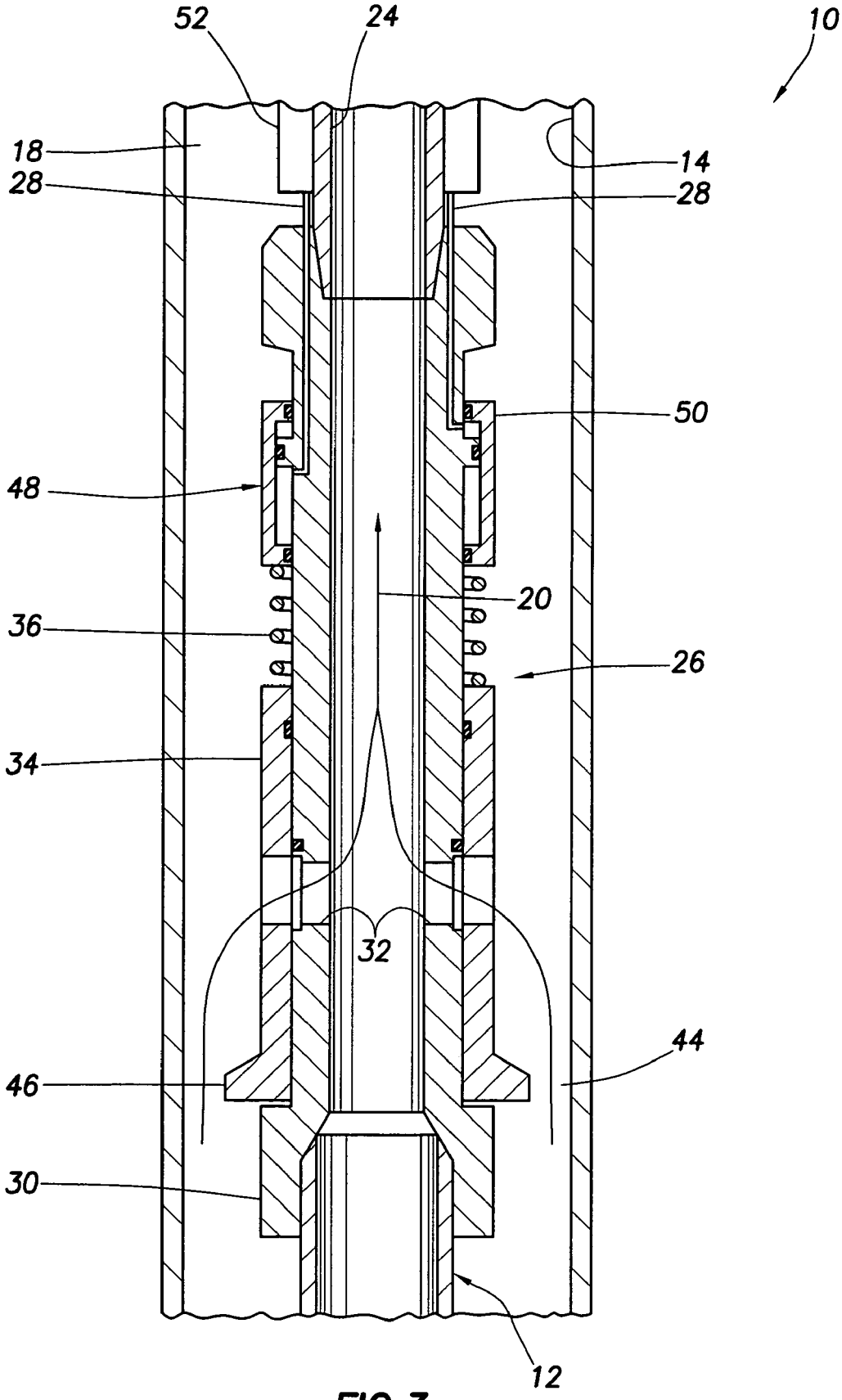
FIG. 3 is a schematic cross-sectional view of the system of FIG. 1 depicting an alternate construction of the flow regulator.

Referring additionally now to FIG. 3, an alternate configuration of the flow regulator 26 is representatively illustrated. This configuration is very similar to that shown in FIG. 2, except that a different actuator 48 is used to vary the biasing force applied by the biasing device 36 to the closure device 34.

The actuator 48 is hydraulically operated and includes a piston 50 reciprocably mounted on the housing 30. Downward displacement of the piston 50 increases the biasing force by further compressing the biasing device 36. Upward displacement of the piston 50 reduces the biasing force by decreasing compression of the biasing device 36. Thus, displacement of the piston 50 results in changes in the flow rate of the fluid 20 through the openings 32 in a manner similar to that described above for displacement of the sleeve 40.

The lines 28 may be used to apply pressure to the piston 50 from a remote location, or from a location proximate to the flow regulator 26 as described below. Note that a single line 28 may be used instead of multiple lines. A volume metering device 52 may be connected to one or both of the lines 28 to permit predetermined volumes of fluid to be metered into or out of the actuator 48, for example, to produce known incremental displacements of the piston 50 and thereby produce known incremental changes in the flow rate of the fluid 20.

The device 52 may be any type of volume metering device. For example, any of the devices described in U.S. Pat. No. 6,585,051 may be used, e.g., to discharge a predetermined volume of fluid into the actuator 48. As another example, the device described in U.S. application Ser. No. 10/643,488 filed Aug. 19, 2003 may be used, e.g., to permit discharge of a predetermined volume of fluid from the actuator 48. The entire disclosures of the U.S. patent and application mentioned above are incorporated herein by this reference.

The configuration of the flow regulator 26 depicted in FIG. 3 demonstrates that various types of actuators may be used in the flow regulator. For example, electrical (such as solenoids, etc.), mechanical, hydraulic, thermal, optical, magnetic and other types of actuators may be used. A mechanical actuator of the type known to those skilled in the art as a ratchet or J-slot mechanism could be used to mechanically increment the displacements of the sleeves 40, 50 in a manner similar to the way the device 52 permits displacement of the sleeve 50 to be hydraulically incremented. Furthermore, these actuators may be used for purposes other than, or in addition to, varying the biasing force exerted by the biasing device 36.

Figure 4:
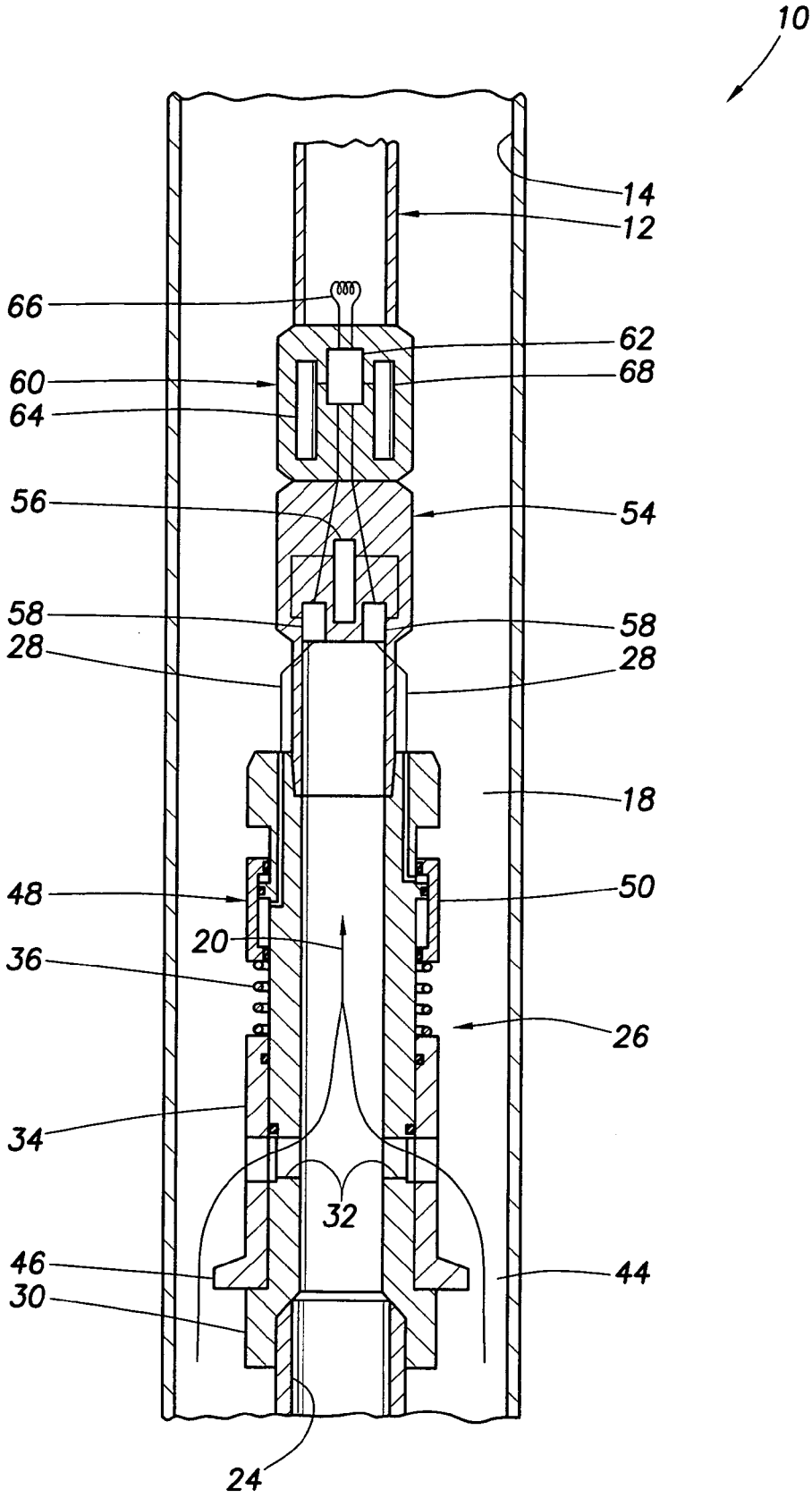
FIG. 4 is a schematic cross-sectional view of the system of FIG. 1 depicting another alternate construction of the flow regulator.

Referring additionally now to FIG. 4, another alternate configuration of the flow regulator 26 is representatively illustrated. This configuration of the flow regulator 26 is similar to that depicted in FIG. 3, except that the lines 28 are connected to a downhole pressure source 54.

The pressure source 54 is interconnected in the tubular string 12 and is connected directly or indirectly to the flow regulator 26. The pressure source 54 could be combined with the flow regulator 26 in a single well tool, or they can be separately provided, as shown in FIG. 4.

The pressure source 54 preferably includes a downhole pump 56 and flow control devices 58 (e.g., valves, manifolds, volume metering devices, etc.) interconnected between the pump and the lines 28. Preferably, the pump 56 operates in response to flow of the fluid 20 through the passage 24, although other types of pumps may be used if desired (such as an electric pump, etc.).

The flow control devices 58 are preferably operated in response to signals received from a control module 60 interconnected in the tubular string 12. The control module 60 may be combined with either or both of the pressure source 54 and flow regulator 26, or it may be separately provided as shown in FIG. 4. Note that the flow control devices 58 could be controlled from a remote location, with or without use of the control module 60.

The control module 60 preferably includes a processor 62 and one or more sensors 64. The sensor 64 senses a downhole parameter (such as temperature, pressure, flow rate, resistivity, density, water cut, gas cut and/or other parameters) and provides an output to the processor 62. The processor 62 is programmed to operate the flow control devices 58 and/or pump 56 to actuate the actuator 48 so that a desired flow rate of the fluid 20 is achieved based on the downhole parameter (s).

For example, if the sensor 64 detects an increased water cut, the processor 62 may be programmed to cause the pressure source 54 to actuate the actuator 48 so that the flow rate of the fluid 20 is decreased. The processor 62 may be reprogrammed downhole using an inductive coupling 66 of the type well known to those skilled in the art, or telemetry methods (such as electromagnetic, acoustic, pressure pulse, wired or wireless telemetry, etc.) may be used to reprogram the processor.

The processor 62 and other components of the system 10 (such as the sensor 64, pump 56, flow control devices 58, etc.) may be provided with electrical power using a downhole battery 68. The battery 68 may be replaceable or rechargeable downhole. Alternative electrical power sources include downhole generators, fuel cells, electrical lines extending to a remote location, etc.

The configuration of the system 10 depicted in FIG. 4 demonstrates that the flow rate of the fluid 20 may be changed intelligently downhole based on parameters of the downhole environment. The processor 62 may be programmed to utilize complex relationships between multiple downhole parameters in controlling operation of the flow regulator 26. The processor 62 could include neural networks or other types of learning algorithms to optimize the flow rate of the fluid 20.

Figure 5:
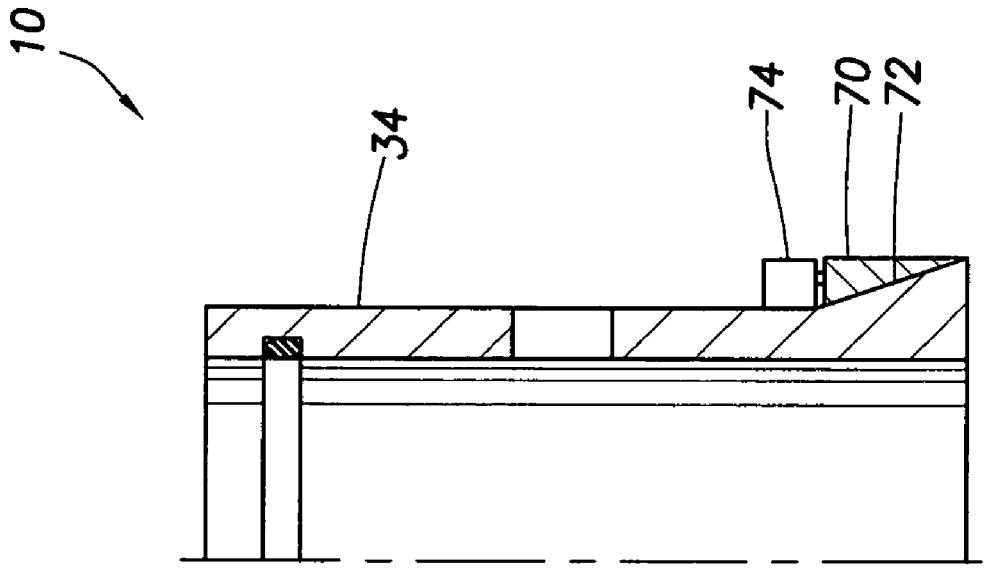
FIG. 5 is an enlarged scale schematic cross-sectional view of an alternate configuration of a closure device of the flow regulator.

Referring additionally now to FIG. 5, an alternate configuration of the closure device 34 is representatively illustrated apart from the remainder of the flow regulator 26. In this configuration of the closure device 34, an adjustable projection 70 is used in place of the fixed projection 46 described above.

As depicted in FIG. 5, the projection 70 is generally wedge-shaped and is reciprocably mounted on an inclined surface 72 of the closure device 34. The projection 70 could instead be any type of extendable device, such as a C-ring, segmented or spirally shaped device, expanding cone, etc. An actuator 74 (such as an electrical, hydraulic, mechanical, optical, thermal, magnetic, or other type of actuator) is used to displace the projection 70 relative to the surface 72 to thereby radially extend and retract the projection.

If the projection 70 is displaced downward by the actuator 74, it will extend outward and further increase the restriction to flow through the annulus 18. This will increase the pressure differential across the projection 70 and thereby increase the upwardly directed force applied to the closure device 34.

If the projection 70 is displaced upward by the actuator 74, it will retract inward and decrease the restriction to flow through the annulus 18. This will decrease the pressure differential across the projection 70 and thereby decrease the upwardly directed force applied to the closure device 34.

Thus, it will be readily appreciated by those skilled in the art that the flow restriction 44 may be varied to change the flow rate of the fluid 20 through the openings 32. Note that the flow rate of the fluid 20 may be changed by varying the flow restriction 44 in addition to, or as an alternative to, varying the biasing force exerted by the biasing device 36 on the closure device 34. The actuator 74 may be controlled by the control module 60 described above and, if hydraulically operated, may be supplied with pressure by the pressure source 54.

Figure 6:
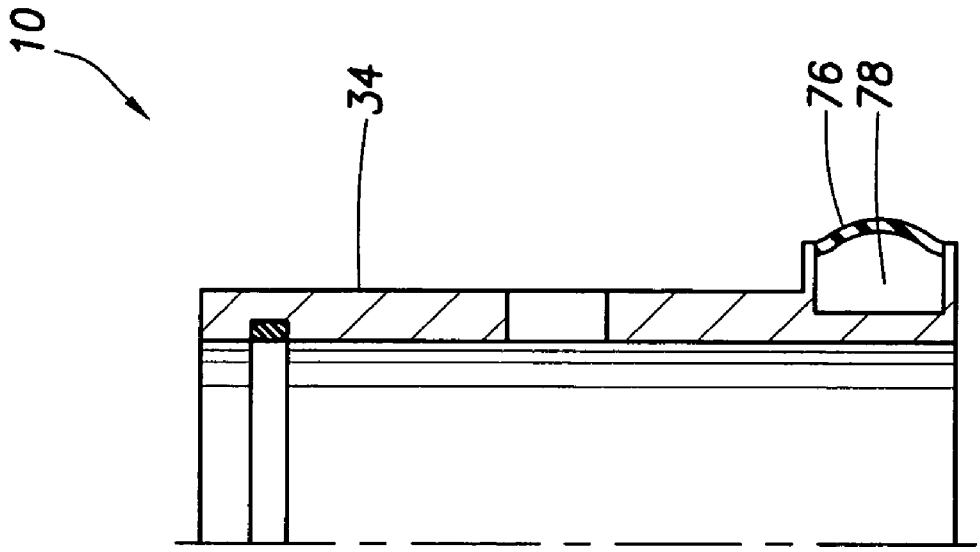
FIG. 6 is a schematic cross-sectional view of another alternate configuration of the closure device.

Referring additionally now to FIG. 6, another alternate configuration of the closure device 34 is representatively illustrated. In this configuration, a projection 76 is used which is in the form of an expandable bladder or membrane. Pressure may be varied in a chamber 78 of the closure device 34 to extend or retract the projection 76 as desired to respectively increase or decrease the resistance to flow of the fluid 20 through the restriction 44 and thereby increase or decrease the upwardly directed force applied to the closure device. The chamber 78 may be connected to the pressure source 54, with the pressure level being regulated by the control module 60.

Figure 7:
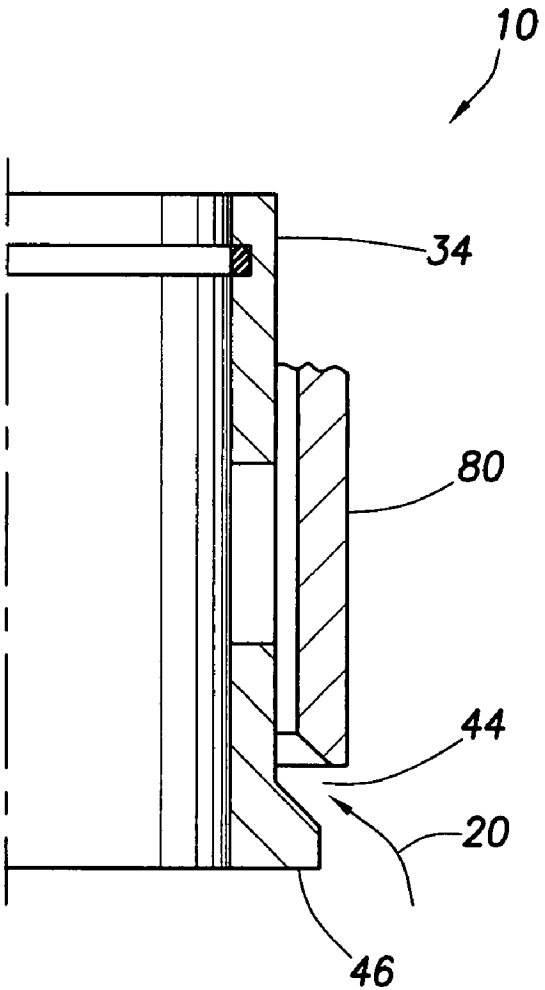
FIG. 7 is a schematic cross-sectional view of a further alternate configuration of the closure device.

Referring additionally now to FIG. 7, another alternate configuration of the closure device 34 is representatively illustrated. In this configuration, the flow restriction 44 is formed between the projection 46 and an outer sleeve 80 of the flow regulator 26.

Thus, it is not necessary in keeping with the principles of the invention for the flow restriction 44 to be formed between the flow regulator 26 and the wellbore 14 in the annulus 18. The flow restriction 44 can instead be positioned in the flow regulator 26 itself.

The outer sleeve 80 may displace with the closure device 34, so that the flow restriction 44 remains constant as the closure device displaces relative to the housing 30. The outer sleeve 80 could be integrally formed with the closure device 34. Furthermore, the outer sleeve 80 may be displaceable relative to the closure device 34 (for example, using an actuator such as the actuator 74 described above) to vary the resistance to flow of the fluid 20 through the flow restriction 44. In this manner, the flow rate of the fluid 20 may be changed by varying the force applied to the closure device 34 due to flow of the fluid through the flow restriction 44, as with the configurations depicted in FIGS. 5 and 6.

Figure 8:
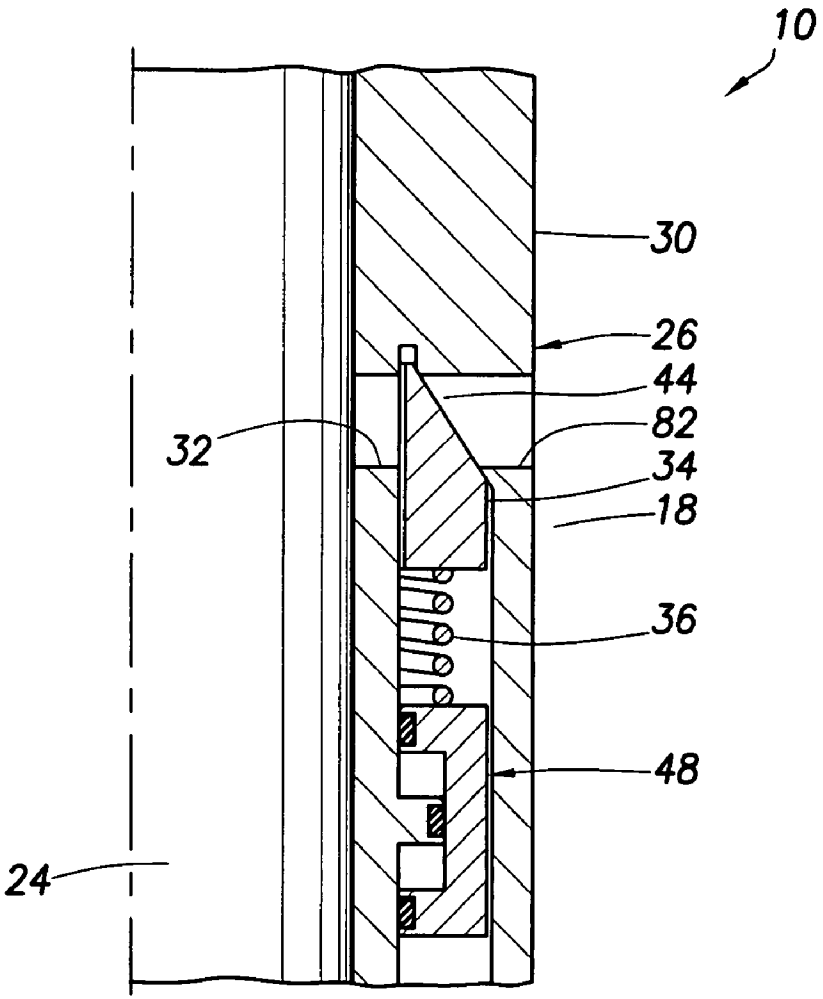
FIG. 8 is a schematic cross-sectional view of another alternate construction of the flow regulator which may be used in the system of FIG. 1.

Referring additionally now to FIG. 8, an alternate configuration of the flow regulator 26 is representatively illustrated. In this configuration, the closure device 34, biasing device 36 and actuator 48 are positioned in a sidewall of the flow regulator 26. The flow restriction 44 is due to the closure device 34 restricting flow through another opening 82 formed through a sidewall of the housing 30.

As depicted in FIG. 8, the opening 82 is completely closed off by the closure device 34, but preferably in operation the closure device will only partially close off the opening. Flow of the fluid 20 through the flow restriction 44 will cause a downwardly directed force to be applied to the closure device 34, while the biasing device 36 applies an upwardly directed biasing force to the closure device. A state of equilibrium will preferably result when these forces are balanced, permitting a desired flow rate of the fluid 20 through the opening 32.

The actuator 48 may be used to vary the biasing force exerted by the biasing device 36. The actuator 48 could be hydraulically operated as depicted in FIG. 8, or it could be any other type of actuator (such as electrical, mechanical, magnetic, optical, thermal, etc.). The actuator 48 may be supplied with pressure from the pressure source 54 and its operation may be controlled by the control module 60.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well flow regulating system, comprising:

a flow regulator which regulates a flow rate of a fluid in a wellbore, the flow rate remaining substantially constant at a first value while a differential pressure across the flow regulator varies, and the flow regulator being selectively reconfigurable while positioned within the wellbore by at least one of a selectively adjustable biasing force and a selectively adjustable restriction force, which reconfiguration of the flow regulator thereby causes the flow rate to remain substantially constant at a second value different from the first value.

2. The system of claim 1, wherein the flow regulator is reconfigured automatically in response to a change in at least one downhole parameter.

3. The system of claim 2, wherein the parameter is at least one of temperature, pressure, flow rate, resistivity, density, water cut and gas cut.

4. The system of claim 2, further comprising at least one sensor for sensing the parameter, the flow rate being reconfigured in response to an output of the sensor.

5. The system of claim 1, wherein the flow regulator includes an actuator for varying the biasing force applied to a closure device of the flow regulator to thereby adjust the flow rate.

6. The system of claim 5, wherein the actuator is at least one of a hydraulic, electrical, optical, thermal, mechanical and magnetic actuator.

7. The system of claim 1, wherein the flow regulator includes a flow restriction and a closure device, the closure device displacing in response to a variance in a pressure differential across the flow restriction to thereby maintain the flow rate substantially constant.

8. The system of claim 7, wherein the closure device displaces to decrease a flow area in the flow regulator in response to an increase in the pressure differential across the flow restriction.

9. The system of claim 7, wherein the flow restriction is formed between the closure device and the wellbore.

10. A well flow regulating system, comprising:

a tubular string positioned in a wellbore, an annulus being formed between the tubular string and the wellbore; and a flow regulator which maintains a first desired flow rate of a fluid flowing between the annulus and an interior passage of the tubular string, the flow regulator including a closure device, a biasing device which applies a biasing force to the closure device in a first direction, and a flow restricting projection which is acted upon by the fluid and applies a restriction force to the closure device in a second direction opposite to the first direction, the flow rate being changed to a second desired flow rate by at least one of the biasing force and the restriction force being selectively reconfigured downhole.

11. The system of claim 10, wherein the flow regulator includes an actuator which adjusts the biasing force applied to the closure device by the biasing device.

12. The system of claim 11, wherein the biasing force is incrementally adjusted by a mechanical mechanism of the actuator.

13. The system of claim 11, wherein the actuator includes a piston which displaces to vary the biasing force applied to the closure device by the biasing device.

14. The system of claim 13, wherein the piston is incrementally displaced by a fluid volume metering device.

15. The system of claim 13, wherein the piston is displaced by fluid pressure generated by a downhole pump connected to the flow regulator.

16. The system of claim 11, wherein the actuator varies the biasing force in response to a change in at least one downhole parameter.

17. The system of claim 16, wherein the parameter is at least one of temperature, pressure, flow rate, resistivity, density, water cut and gas cut.

18. The system of claim 16, further comprising a sensor which senses the parameter.

19. The system of claim 11, wherein the actuator also varies a flow restriction to thereby adjust the restriction force applied to the closure device.

20. The system of claim 10, wherein a flow restriction is formed in the annulus between the flow regulator and the wellbore.

21. The system of claim 11, wherein a flow restriction is formed internally in the flow regulator.

22. The system of claim 10, wherein the restriction force is adjusted by varying a flow area in the annulus.

23. The system of claim 10, wherein the restriction force is adjusted by varying a flow area within the flow regulator.

24. The system of claim 10, wherein the flow regulator further includes an actuator which adjusts the restriction force.

25. The system of claim 24, wherein the actuator displaces a device to vary a flow area at the flow restriction.

26. The system of claim 24, wherein the actuator varies the restriction force in response to a change in at least one downhole parameter.

27. The system of claim 26, wherein the parameter is at least one of temperature, pressure, flow rate, resistivity, density, water cut and gas cut.

28. The system of claim 26, further comprising a sensor which senses the parameter.

29. The system of claim 10, further comprising a control module connected to the flow regulator, the control module including at least one sensor for sensing a downhole parameter.

30. The system of claim 29, wherein the flow rate is changed in response to an output of the sensor.

31. The system of claim 29, wherein the control module further includes a processor which is programmable to change the flow rate in response to an output of the sensor.

32. The system of claim 31, wherein the processor is programmable downhole.

33. The system of claim 29, further comprising a pressure source connected to the flow regulator and the control module, the pressure source changing the flow rate as directed by the control module.

34. The system of claim 33, wherein the pressure source includes a downhole pump.

35. A well flow regulating system, comprising:

a tubular string positioned in a wellbore, an annulus being formed between the tubular string and the wellbore; and a flow regulator which regulates flow of a fluid flowing between the annulus and an interior passage of the tubular string, the flow regulator including a closure device, a biasing device which applies a biasing force to the closure device in a first direction, and a flow restricting projection which is acted upon by the fluid and applies a restriction force to the closure device in a second direction opposite to the first direction, at least one of the biasing force and the restriction force being adjustable downhole to achieve a first desired flow rate of the fluid, and at least one of the biasing force and the restriction force being adjustable downhole to achieve a second desired flow rate of the fluid, wherein the flow regulator includes an actuator which adjusts the biasing force applied to the closure device by the biasing device, and wherein the actuator includes a material responsive to temperature change in the wellbore to vary the biasing force applied to the closure device by the biasing device.

36. A well flow regulating system, comprising:

a flow regulator which regulates a flow rate of a fluid in a wellbore through a flow path in the regulator, the flow rate remaining substantially constant while a differential pressure across the flow regulator varies, and the flow regulator being selectively reconfigurable while positioned within the wellbore by at least one of a selectively adjustable biasing force and a selectively adjustable restriction force, wherein the flow regulator includes a flow restriction, and a closure device which displaces in response to a variance in a pressure differential across the flow restriction to thereby maintain the flow rate substantially constant, and wherein the flow restriction is formed between the closure device and the wellbore.

37. A well flow regulating system, comprising:

a tubular string positioned in a wellbore, an annulus being formed between the tubular string and the wellbore; and a flow regulator which maintains a desired flow rate of a fluid flowing through a flow path between the annulus and an interior passage of the tubular string, the flow regulator including a closure device, a biasing device which applies a biasing force to the closure device in a first direction, and a flow restricting projection which is acted upon by the fluid and applies a restriction force to the closure device in a second direction opposite to the first direction, the characteristics of the flow path being changed by at least one of the biasing force and the restriction force being selectively reconfigured downhole, wherein the flow regulator includes an actuator which adjusts the biasing force applied to the closure device by the biasing device, and the actuator includes a piston which displaces to vary the biasing force applied to the closure device by the biasing device.

* * * * *